US011078713B1

(12) United States Patent
Baker et al.

(10) Patent No.: US 11,078,713 B1
(45) Date of Patent: Aug. 3, 2021

(54) GUN SAFE WITH SLIDING DRAWER

(71) Applicants: Michael Scott Baker, Henderson, NV (US); Jesus Carballido, Henderson, NV (US)

(72) Inventors: Michael Scott Baker, Henderson, NV (US); Jesus Carballido, Henderson, NV (US)

(73) Assignee: Cannon Security Products

( * ) Notice: Subject to any disclaimer, the term of this patent is extended or adjusted under 35 U.S.C. 154(b) by 340 days.

(21) Appl. No.: 16/280,907

(22) Filed: Feb. 20, 2019

(51) Int. Cl.

| | |
|---|---|
| ***E05G 1/02*** | (2006.01) |
| ***E05B 65/00*** | (2006.01) |
| ***E05B 37/00*** | (2006.01) |
| ***E05G 1/024*** | (2006.01) |
| ***E05G 1/04*** | (2006.01) |

(52) U.S. Cl.
CPC ..... *E05G 1/02* (2013.01); *E05B 37/0031* (2013.01); *E05B 65/0075* (2013.01); *E05G 1/024* (2013.01); *E05G 1/04* (2013.01)

(58) Field of Classification Search
CPC .. E05G 1/02; E05G 1/024; E05G 1/04; E05G 1/005; E05G 1/026; E05G 2700/02; E05B 65/0075; E05B 37/0031; A47B 46/00; A47B 81/00; A47B 81/005; A47B 2088/421
USPC ..... 70/63, 85–88, 279.1; 109/45, 47, 59 R, 109/64; 312/215, 273, 274, 310, 348.4; 42/70.11; 206/317; 211/64; 224/912, 224/913
See application file for complete search history.

(56) References Cited

U.S. PATENT DOCUMENTS

| | | | | |
|---|---|---|---|---|
| 1,584,294 | A * | 5/1926 | Heise | E05G 7/001 109/47 |
| 2,473,467 | A | 6/1949 | Burt | |
| 2,796,310 | A * | 6/1957 | Anderson | B60R 7/06 312/246 |
| 3,425,765 | A | 2/1969 | Levy | |
| 4,452,390 | A * | 6/1984 | West | E05G 1/005 109/45 |
| 4,800,822 | A | 1/1989 | Adkins | |
| 5,005,729 | A | 4/1991 | Hollman | |
| 5,111,755 | A * | 5/1992 | Rouse | A47B 81/005 109/25 |
| 5,317,888 | A | 6/1994 | Towns | |
| 5,884,989 | A | 3/1999 | Truelove | |
| 5,901,589 | A | 5/1999 | Cordero | |
| 6,009,654 | A | 1/2000 | Williams | |

(Continued)

*Primary Examiner* — Lloyd A Gall
(74) *Attorney, Agent, or Firm* — Quickpatents, LLC; Kevin Prince

(57) ABSTRACT

A safe for a firearm includes a container having a front opening that slidably receives a drawer having an open top that holds a firearm in a presentation position. A drop-down panel is slidably around the first side, front, and second side of the drawer when the drawer is in an extended potion. The drop-down panel is raised at least partially above the first side, front, and second side of the drawer when the drawer is in a retracted position inside the container to seal the front opening. A ramp is fixed within the internal volume of the container that raises the drop-down panel when the drawer is pushed backwardly into the container. A latch retains the drawer in the retracted position against a spring that urges the drawer into the extended position, and is selectively openable with a lock that releases the latch.

12 Claims, 9 Drawing Sheets

(56) References Cited

U.S. PATENT DOCUMENTS

| | | | | |
|---|---|---|---|---|
| 6,405,861 | B1 | 6/2002 | Siler | |
| 6,570,501 | B2 | 5/2003 | Bushnell | |
| 6,824,134 | B2 * | 11/2004 | Abe | G07D 11/12 271/171 |
| 7,178,370 | B2 | 2/2007 | Engel | |
| 7,299,667 | B1 * | 11/2007 | Miresmaili | E05B 73/00 109/51 |
| 7,434,427 | B1 | 10/2008 | Miresmaili | |
| 7,478,724 | B2 | 1/2009 | Vor Keller | |
| 8,186,188 | B1 | 5/2012 | Brown | |
| 8,201,900 | B2 | 6/2012 | Backhaus | |
| 8,746,024 | B2 * | 6/2014 | Baker | E05B 47/0012 70/279.1 |
| 9,428,114 | B2 | 8/2016 | Mothersele | |
| 9,803,956 | B2 | 10/2017 | Ellingson | |
| 9,963,927 | B1 * | 5/2018 | Dudley | E05G 1/026 |
| 10,223,874 | B2 * | 3/2019 | Whiteaker | E05G 1/024 |
| 10,948,263 | B2 * | 3/2021 | Mack | E05B 47/06 |
| 2005/0012437 | A1 * | 1/2005 | Schulman | A47B 46/00 312/223.3 |
| 2007/0277712 | A1 | 12/2007 | Stepp | |
| 2009/0322194 | A1 | 12/2009 | Backhaus | |
| 2011/0247950 | A1 | 10/2011 | McGee | |
| 2014/0245934 | A1 | 9/2014 | Delattre | |
| 2015/0129383 | A1 | 5/2015 | Kirby | |
| 2015/0225993 | A1 | 8/2015 | McAlexander | |
| 2016/0123701 | A1 | 5/2016 | Ho | |
| 2017/0234038 | A1 * | 8/2017 | Sanford | E05B 37/0058 70/63 |
| 2017/0306686 | A1 | 10/2017 | Penland | |
| 2019/0226267 | A1 * | 7/2019 | Batdorf, III | E05G 1/026 |

* cited by examiner

GUN SAFE WITH SLIDING DRAWER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to safes, and more particularly to a gun safe with an openable, sliding drawer.

BACKGROUND

Many types of safes have been used to protect valuable items such as a firearm and spare magazines, while, simultaneously providing ready access when the firearm is needed. Such safes typically use an electronic lock having a combination keypad or a biometric sensor such as a fingerprint scanner. Such safes typically also include a mechanical lock in case the combination is lost or the biometric sensor fails to read correctly. Once purpose of such safes is to keep children away from firearms while also providing ready access to the firearm in an emergency situation.

Our previous product, the GunVault® brand SpeedVault Handgun Safe (https://www.gunvault.com/product/speed-vault/), while accomplishing these objectives, has several drawbacks that make such a product unsuitable in certain circumstances. For example, the SpeedVault Handgun Safe required a lower clearance since the drawer holding the firearm pivots downwardly when opening, and thus any obstruction below the unit prevents the device from opening to present the handgun. Further, a front wall of the drop-down drawer has a front surface that projects upwardly in a manner that can obstruct the user from grasping the handgun from a forward direction, and side walls of the container of the device also can obstruct a user's hand reaching for the handgun laterally.

Therefore, there is a need for a device that allows quick access to a handgun or the like when opened, and in an unobstructed manner. Such a needed invention would be mountable at a location immediately above an object since the drawer of such a needed invention would slide out forward and not pivot downward. The needed device would further be strong and difficult to pry open or otherwise compromise, and would provide for the safe storage of a handgun and additional ammo, even in environments with children present. The present invention accomplishes these objectives.

SUMMARY OF THE INVENTION

The present device is a safe for a firearm. A container has a top, a bottom, a rear, a front, a first side, and a second side, all defining an internal volume within the container. The front includes a front opening. A drawer has an open top, a first side, a second side, a front, a bottom, and a rear. The drawer is adapted for slidable receipt into the front opening of the container. The open top of the drawer is adapted for holding a portion of the firearm in a presentation position ready for grasping when the drawer is an extended position away from the front of the container. Preferably the drawer is slidably supported within the container between a retracted position and the extended position on a drawer slide mechanism.

A drop-down panel is slidably fixed with and surrounds the first side, front, and second side of the drawer when the drawer is in the extended position. The drop-down panel is raised at least partially above the first side, front, and second side of the drawer when the drawer is in the retracted position inside the container. The drop-down panel and front of the drawer substantially cover the front opening of the container when the drawer is in the retracted position.

A ramp mechanism is fixed within the internal volume of the container and adapted for raising the drop-down panel with respect to the drawer when the drawer is pushed backwardly into the container. Preferably the ramp mechanism further includes at least one rear roller proximate a lower rear side of the drop-down panel and at least one front roller proximate a lower front side of the drop-down panel. The at least one rear roller is adapted to ride on a ramp fixed with the first side and the second side of the container and adjacent to the drop-down panel. Alternately the ramp is fixed with the rear of the container and projects outwardly therefrom into the internal volume adjacent each side, of the container. The at least one front roller is adapted to slide within at least one vertical slot of at least one of the sides of the drawer, traversing proximate the front of the drawer.

A latch is adapted for retaining the drawer in the retracted position against a spring urging the drawer into the extended position. The latch is selectively openable with a lock mechanism that releases the latch when unlocked, allowing the spring to push the drawer into the extended position. Thereafter the drawer may be manually pushed back into the retracted position by manually overcoming the force of the spring until the latch mechanism locks the drawer in place.

As such, in use, with the firearm placed in the presentation position in the top of the drawer, and with the drawer pushed into the retracted position and locked by the latch, access to the firearm is prevented until the lock mechanism is unlocked, thereby releasing the latch so that the spring urges the drawer into the extended position with the firearm reading for grasping.

In some embodiments the latch is disposed proximate the top of the container and within the internal volume of the container. The rear of the drawer extends upwardly to engage the latch and is substantially flush with a top edge of the drop-down panel when the drawer is in the retracted position.

Preferably the lock mechanism includes an electronic combination lock that includes a keypad disposed at the top of the container proximate the front of the container. The lock mechanism disposed within the internal volume of the container proximate the top of the container and out of the way of the rear of the drawer when the drawer is moved between the retracted position and the extended position, but for the latch which contacts the rear of the drawer when the drawer is in the retracted position. The keypad is accessible from outside the container such that when a correct combination is entered into the keypad, the electronic combination lock actuates a motor to release the latch.

An L-shaped mounting bracket is preferably included that has a plurality of mounting prongs adapted to engage mounting slots traversing the container, preferably at the rear, left, right, and bottom of the container. As such, with the mounting bracket affixed with a structure such as a wall, desk, or the like, the mounting bracket supports the container on the structure when the mounting prongs are engaged with any of the mounting slots.

The present invention is a device that allows quick access to a handgun or the like when opened, and provides unobstructed access to the handgun from the side or from the front of the device. The present device is mountable at a location immediately above an object since the drawer of the invention slides open forward and does not pivot downward. The present invention is strong and difficult to pry open or otherwise compromise, and provides for the safe storage of a handgun and additional ammo, even in environments with children present. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
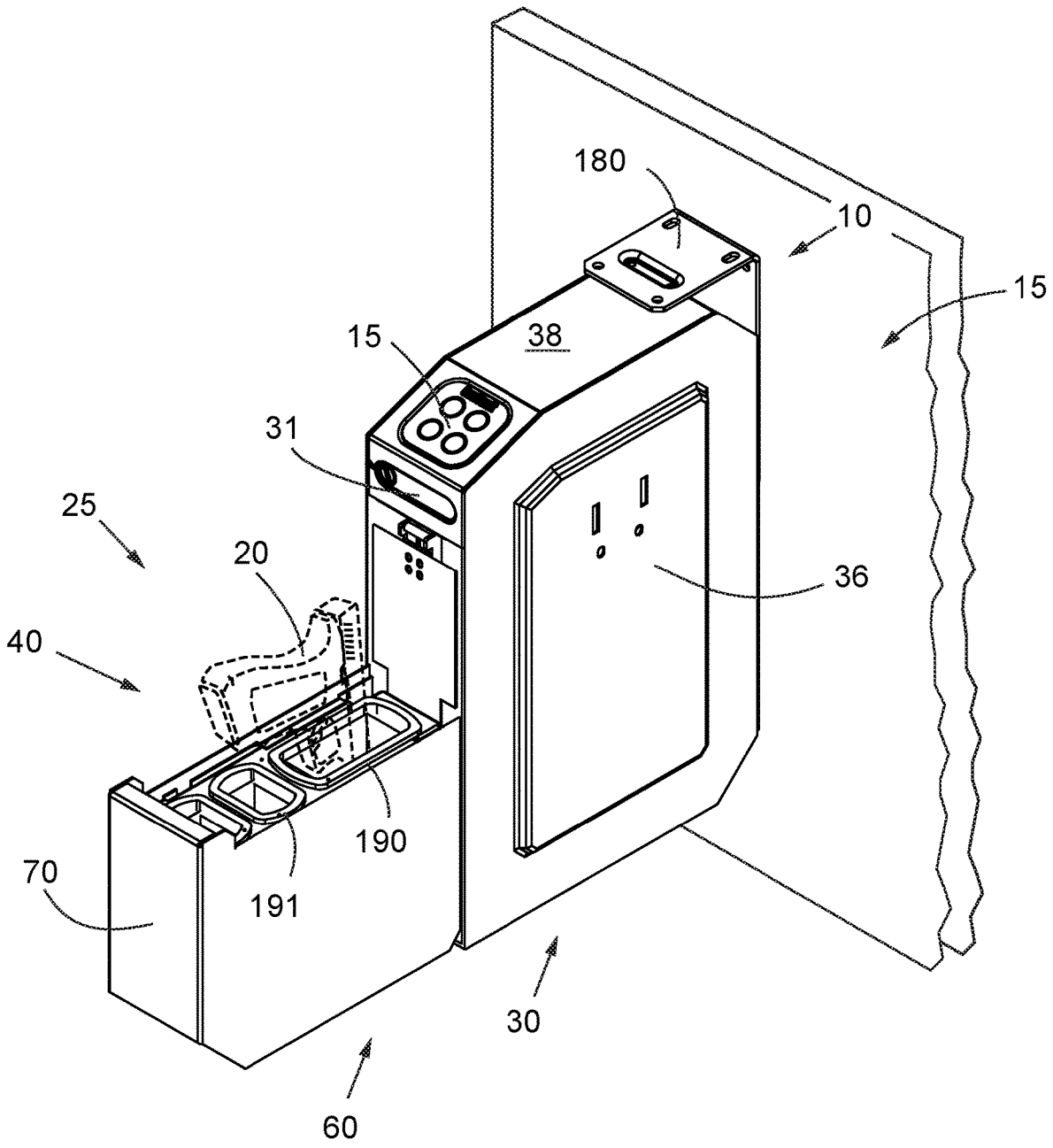
FIG. 1 is a perspective view of the invention, illustrated with a drawer of the invention in an extended position to present a handgun to the user.
Figure 2:
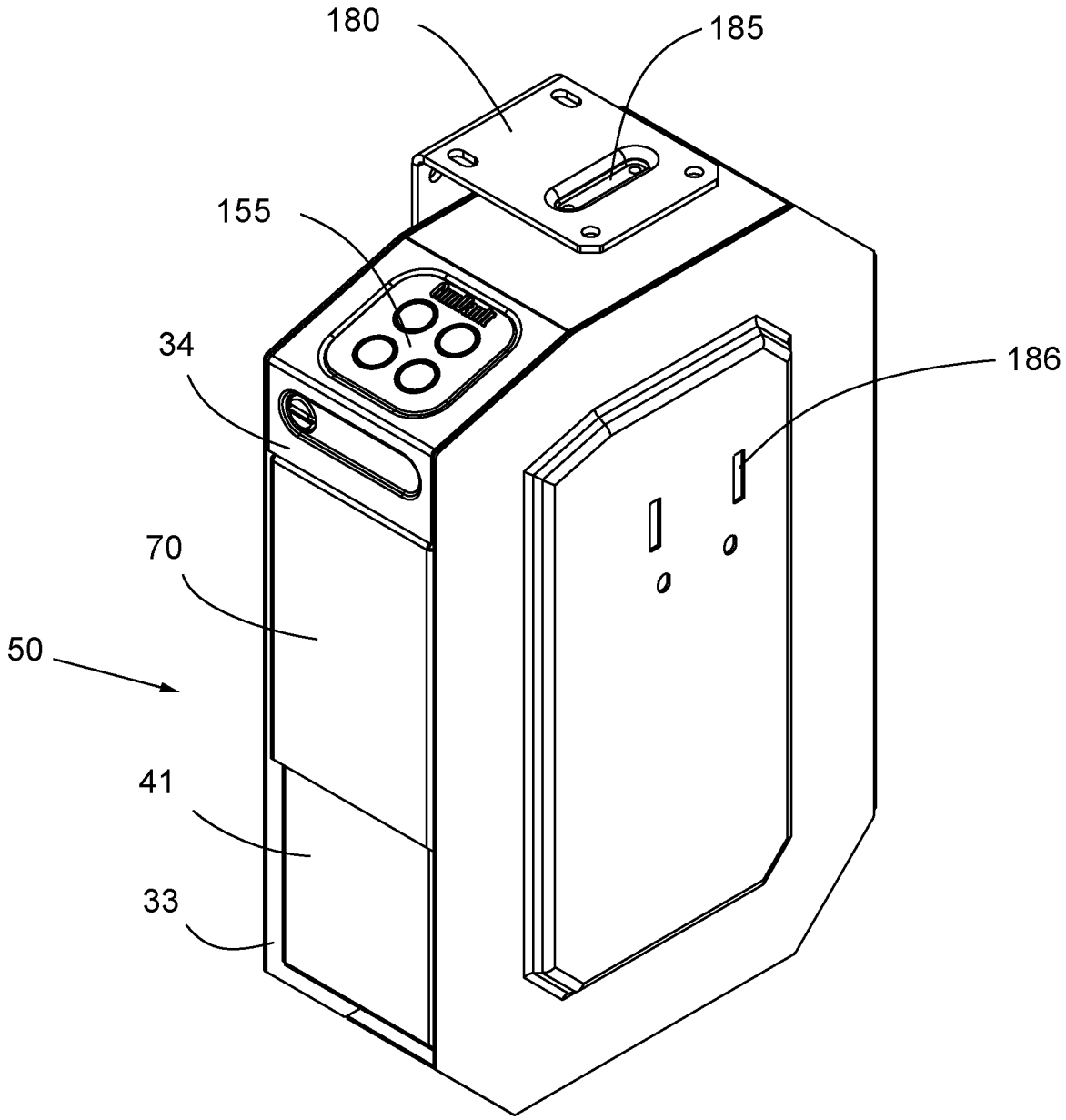
FIG. 2 is a perspective view of the invention, illustrated with the drawer in a retracted position.
Figure 3:
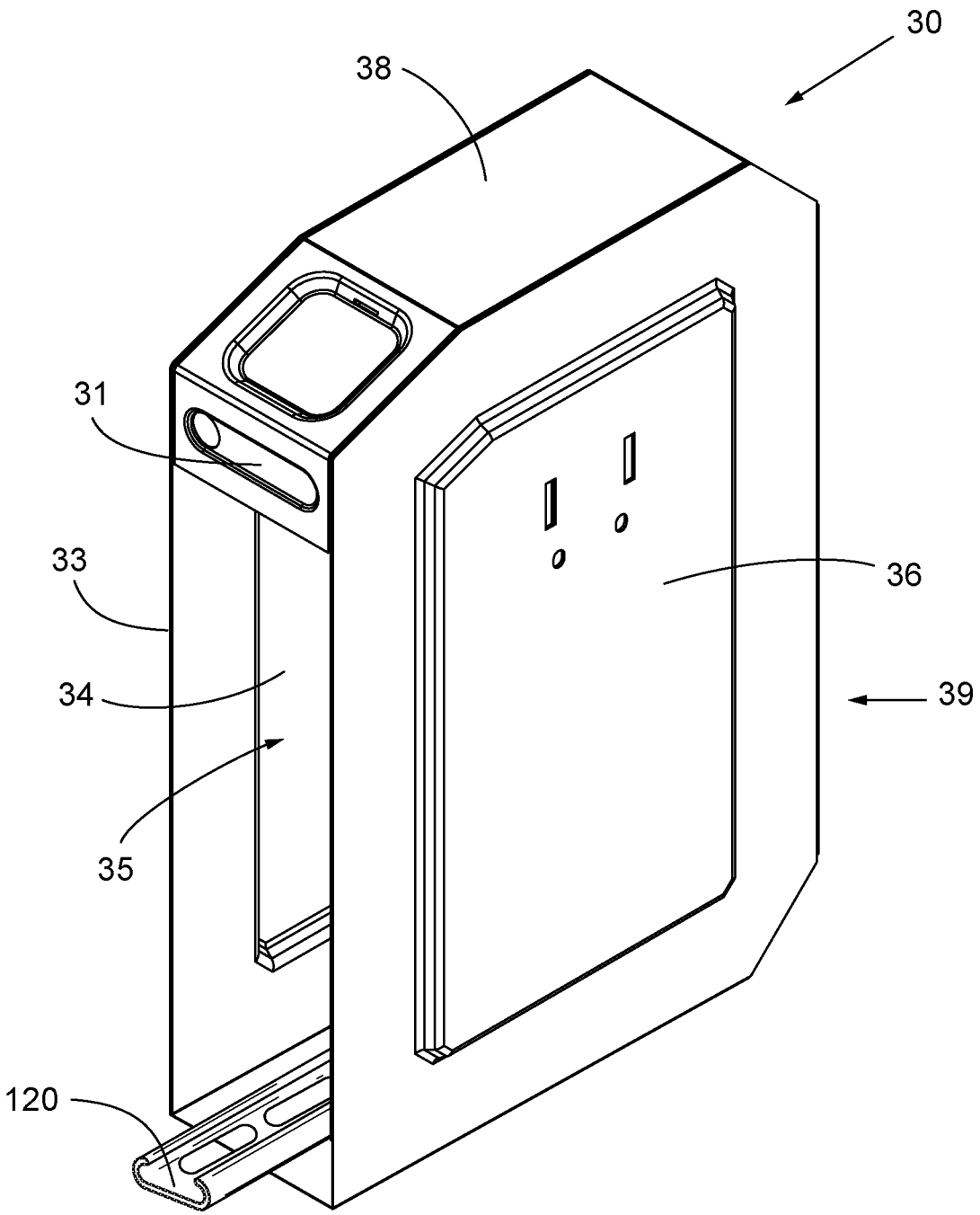
FIG. 3 is a perspective view of the invention, illustrated with the drawer and a drop-down panel omitted for clarity of illustration.

FIGS. 1-3 illustrate a safe 10 for a firearm 20, such as a handgun. A container 30 has a top 38, a bottom, a rear 39, a front 31, a first side 34, and a second side 36, all defining an internal volume 35 within the container 30. The front 31 includes a front opening 33.

A drawer 40 (FIGS. 4A and 4B) has an open top 48, a first side 44, a second side 46, a front 41, a bottom 42, and a rear 49. The drawer is adapted for slidable receipt into the front opening 33 of the container 30. The open top 48 of the drawer 40 is adapted for holding a portion of the firearm 20 in a presentation position 25 ready for grasping when the drawer is an extended position 60 (FIG. 1) away from the front 31 of the container 30. Preferably the drawer 40 is slidably supported within the container 30 between a retracted position 50 (FIG. 2) and the extended position 60 on a drawer slide mechanism 120 (FIG. 3), as is known in the art.

Figure 6A:
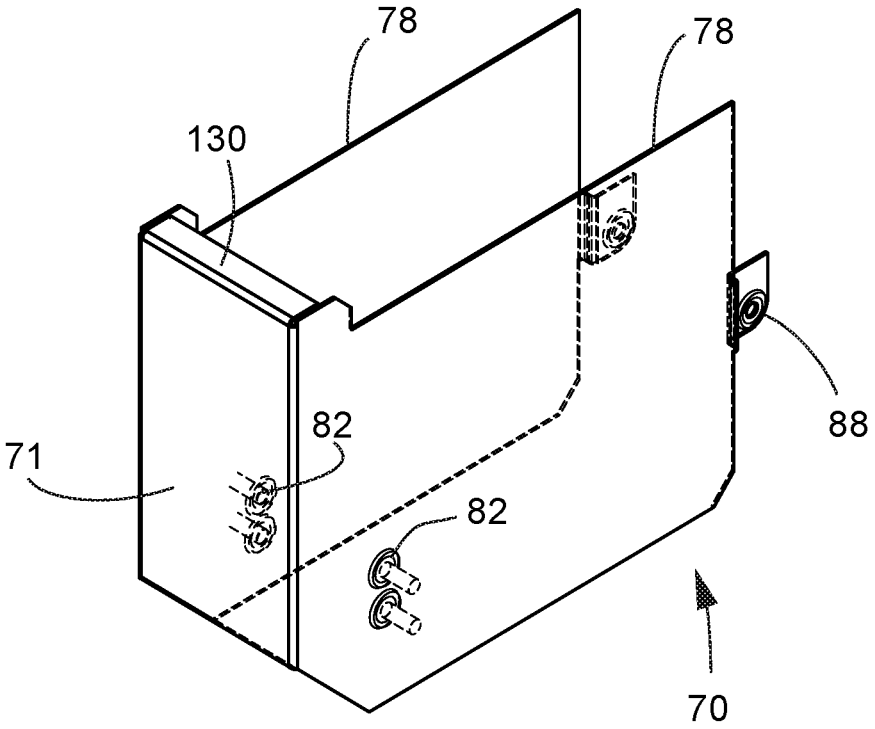
FIG. 6A is a front perspective view of the drop-down panel.

A drop-down panel 70 (FIG. 6A) is slidably fixed with and surrounds the first side 44, front 41, and second side 46 of the drawer 40 when the drawer 40 is in the extended position 60. The drop-down panel 70 is raised at least partially above the first side 44, front 41, and second side 46 of the drawer 40 when the drawer 40 is in the retracted position 50 inside the container 30. The drop-down panel 70 and front 41 of the drawer 40 substantially cover the front opening 33 of the container 30 when the drawer 40 is in the retracted position 50.

Figure 4A:
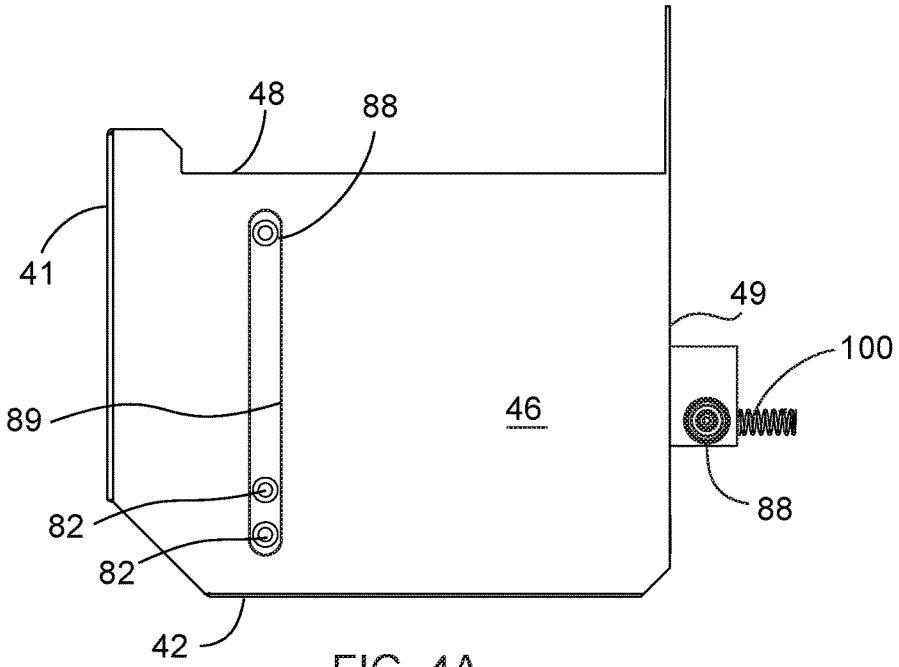
FIG. 4A is a right-side elevational view of the drawer.
Figure 4B:
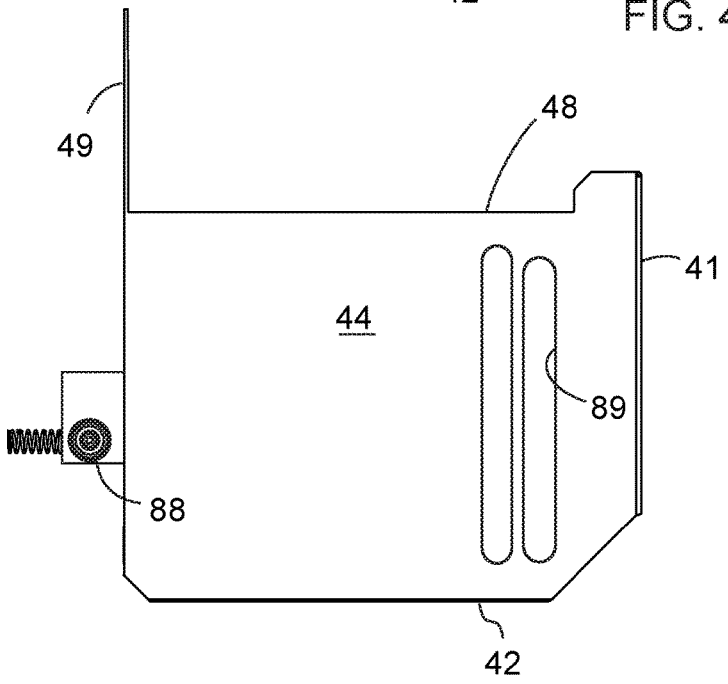
FIG. 4B is a left-side elevational view of the drawer.
Figure 5:
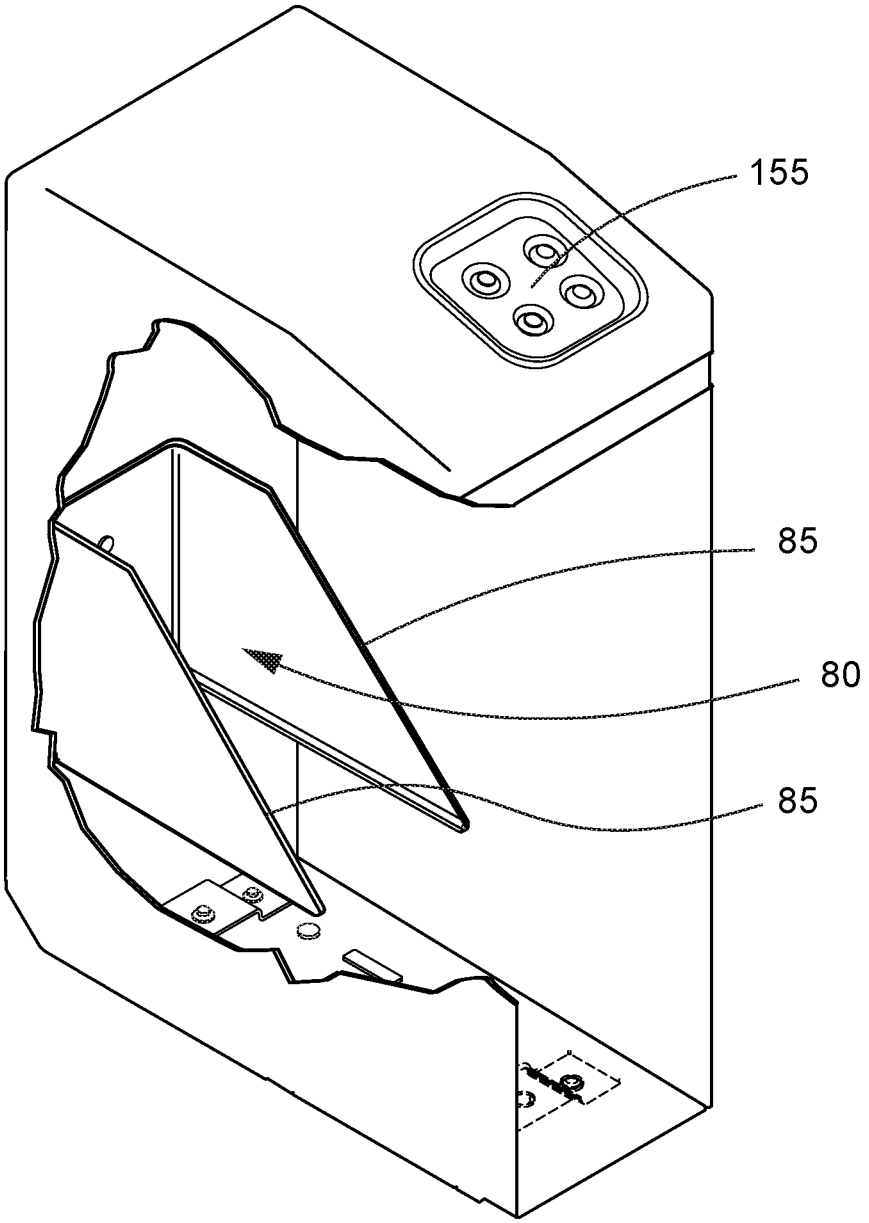
FIG. 5 is a perspective view of the invention, illustrated with the drawer and a drop-down panel omitted for clarity of illustration and with a container of the invention partially cut-away to reveal a ramp mechanism.

A ramp mechanism 80 (FIG. 5) is fixed within the internal volume 35 of the container 30 and adapted for raising the drop-down panel 70 with respect to the drawer 40 when the drawer 40 is pushed backwardly into the container 30. Preferably the ramp mechanism 80 further includes at least one rear roller 88 (FIG. 6A) proximate a lower rear side of the drop-down panel 70 and at least one front roller 82 proximate a lower front side 71 of the drop-down panel 70. The at least one rear roller 88 is adapted to ride on a ramp 85 fixed with the first side 34 and the second side 36 of the container 30 and adjacent to the drop-down panel 70. Alternately the ramp 85 is fixed with the rear 39 of the container 30 and projects outwardly therefrom into the internal volume 35 adjacent each side 34,36 of the container 30. The at least one front roller 82 is adapted to slide within at least one vertical slot 89 of at least one of the sides 44,46 of the drawer 40, traversing proximate the front 41 of the drawer 40 (FIGS. 4A and 4B). Preferably the container 30, drawer 40, drop-down panel 70, and ramp mechanism 80 are all formed with a strong, rigid metallic material such as sheet steel or aluminum.

Figure 6B:
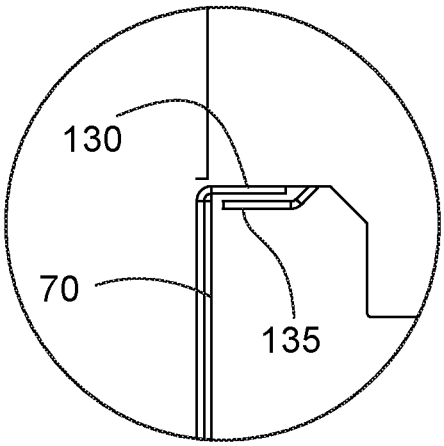
FIG. 6B is a partial enlarged view of the invention, illustrating a locking flange of the drop-down panel and a cooperative locking slot of the container.

A latch 90 is adapted for retaining the drawer 40 in the retracted position 50 against a spring 100 urging the drawer 40 into the extended position 60. The latch 90 is selectively openable with a lock mechanism that releases the latch 90 when unlocked, allowing the spring 100 to push the drawer 40 into the extended position 60. Thereafter the drawer 40 may be manually pushed back into the retracted position 50 by manually overcoming the force of the spring 100 until the latch mechanism 90 locks the drawer 40 in place. Preferably the drop-down panel 70 further includes an upper locking flange 130 (FIGS. 6A and 6B) adapted for receipt within an upper locking slot 135 of the front 31 of the container 30 proximate the top 38 of the container 30. As such the upper locking flange 130 of the drop-down panel 70 is received within the upper locking slot 135 of the container 30 when the drawer is in the retracted position 50 to inhibit prying open of the container 30 at the drop-down panel 70.

As such, in use, with the firearm 20 placed in the presentation position 25 (FIG. 1) in the top 48 of the drawer 40, and with the drawer 40 pushed into the retracted position 50 (FIG. 2) and locked by the latch 90, access to the firearm 20 is prevented until the lock mechanism 110 is unlocked, thereby releasing the latch 90 so that the spring 100 urges the drawer 40 into the extended position 60 with the firearm 20 reading for grasping.

In some embodiments the latch 90 is disposed proximate the top 38 of the container 30 and within the internal volume 35 of the container 30. The rear 49 of the drawer 40 extends upwardly to engage the latch 90 (FIG. 4B) and is substantially flush with a top edge 78 of the drop-down panel 70 when the drawer 40 is in the retracted position 50.

Figure 7:
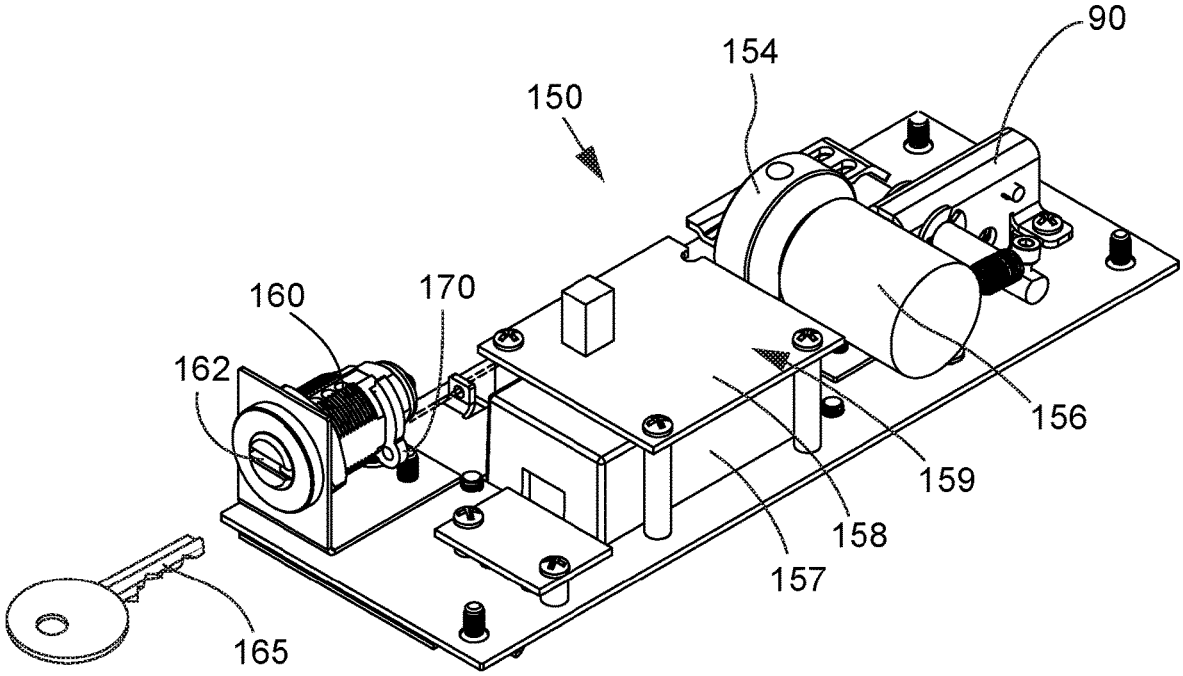
FIG. 7 is a perspective view of a lock mechanism of the invention, illustrating a cooperative key for a mechanical key lock and a motor and flywheel for releasing a latch of the invention.
Figure 9:
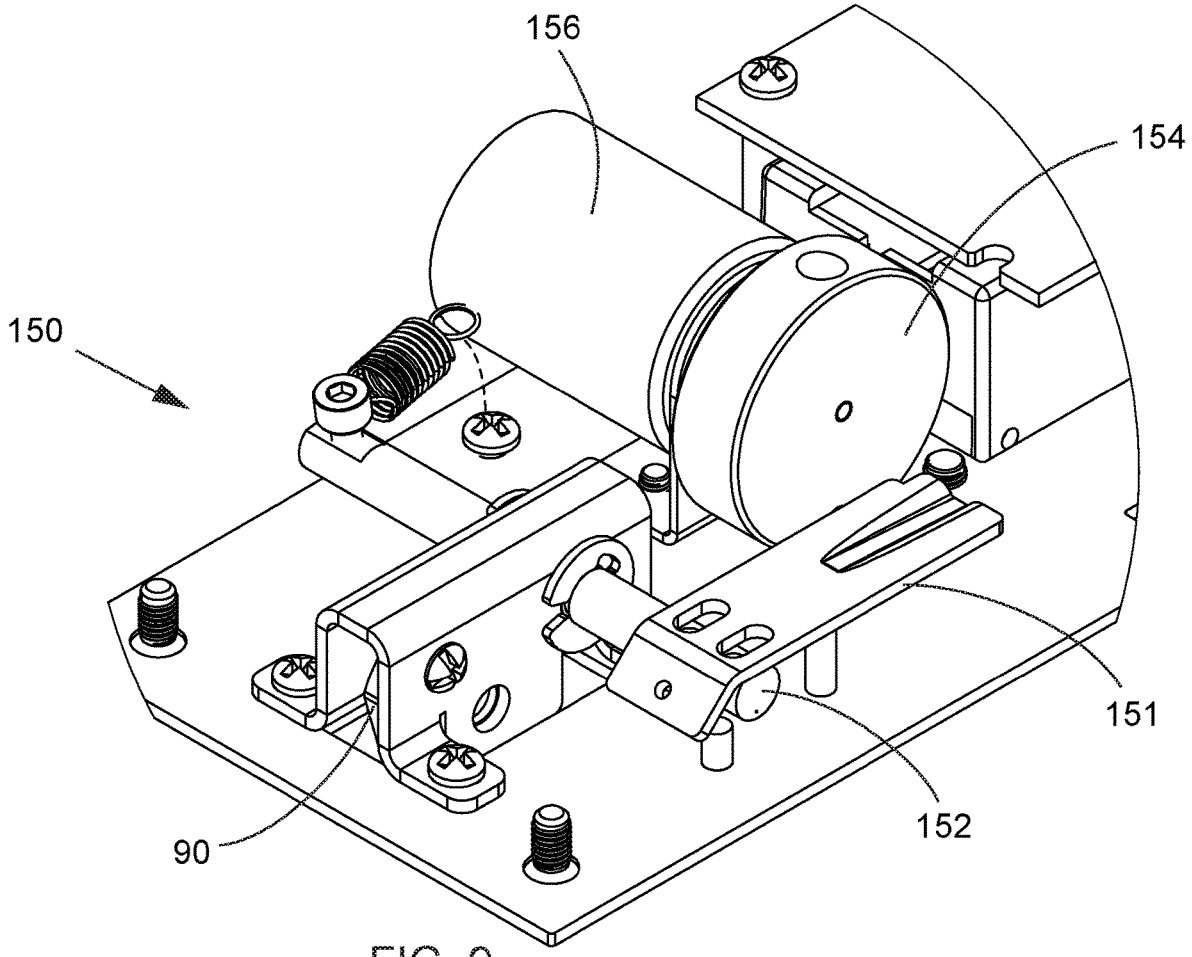
FIG. 9 is an enlarged perspective view of the motor, flywheel, and latch mechanism.
Figure 10:
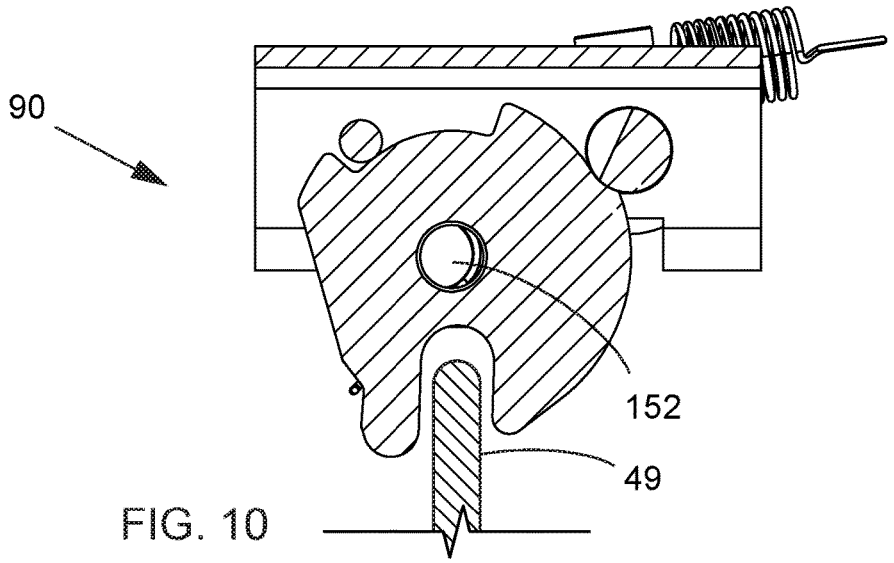
FIG. 10 is a cross-sectional view of the latch.

Preferably the lock mechanism 110 includes an electronic combination lock 150 (FIGS. 7 and 9) that includes a keypad 155 (FIG. 2) disposed at the top 38 of the container 30 proximate the front 31 of the container 30. The lock mechanism 110 disposed within the internal volume 35 of the container 30 proximate the top 38 of the container 30 and out of the way of the rear 49 of the drawer 40 when the drawer 40 is moved between the retracted position 50 and the extended position 60, but for the latch 90 which contacts the rear 49 of the drawer 40 when the drawer 40 is in the retracted position 50. The keypad 155 is accessible from outside the container 30 such that when a correct combination is entered into the keypad 155, the electronic combination lock actuates a motor 156 to release the latch 90. Preferably the electronic combination lock 150 further includes a flywheel 154 (FIG. 9) fixed with the motor 156 and adapted to rotate through a lock pin arm 151 a lock pin 152 that releases the latch 90 (FIG. 10). The electronic combination lock 150 may further include a battery 157, and a circuit board 158 that has a circuit 159 adapted to control the motor 156 based on inputs made to the keypad 155. Such a locking mechanism may be similar to, for example, that taught in U.S. Pat. No. 8,746,024, incorporated herein by reference.

Further, the lock mechanism 110 preferably includes a mechanical key lock 160 (FIGS. 7 and 9) that includes a key slot 162 at the front 31 of the container 30 proximate the top 38 of the container 30. When a corresponding key 165 is turned in the mechanical key lock 160 an armature 170 or linkage between the mechanical key lock 160 and the latch 90 releases the latch 90.

Figure 8:
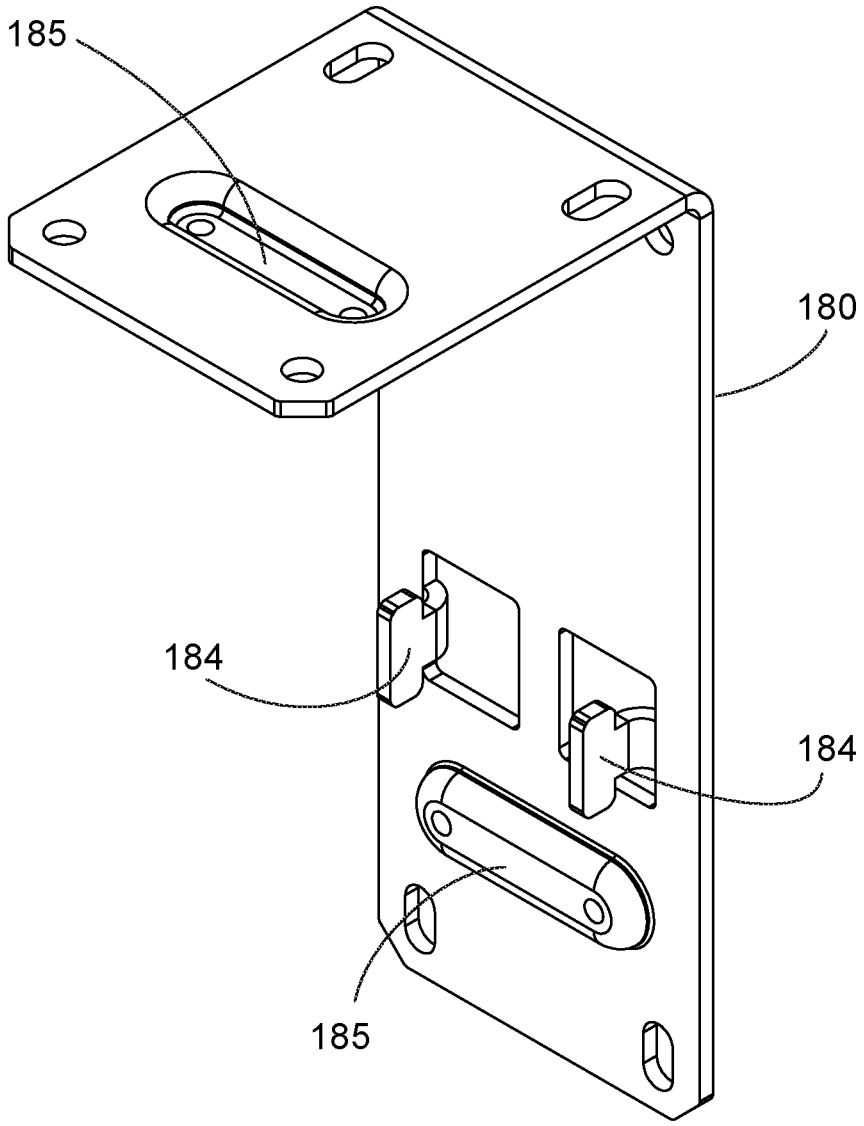
FIG. 8 is a perspective view of an L-shaped mounting bracket of the invention that is adapted to engage the container to hold the container to a structure.

An L-shaped mounting bracket 180 (FIG. 8) is preferably included that has a plurality of mounting prongs 184 adapted to engage mounting slots 186 (FIG. 2) traversing the container 30, preferably at the rear 39, left 34, right 36, and bottom of the container 30. As such, with the mounting bracket 180 affixed with a structure 15 such as a wall (not shown), desk (not shown), or the like, the mounting bracket 180 supports the container 30 on the structure 15 (FIG. 1) when the mounting prongs 184 are engaged with any of the mounting slots 186. At least two standoffs 185 are further preferably included on the mounting bracket 180 for contacting the container 30 when the container 30 is mounted to the mounting bracket 180, aiding in maintaining the container 30 in a parallel orientation to the structure 15.

The top 48 of the drawer 40 preferably further includes a gun holder insert 190 adapted to fit the firearm 20 and maintain the firearm 20 in the presentation position 25, as well as at least one spare magazine holder 191, each adapted for holding one spare magazine (not shown).

While a particular form of the invention has been illustrated and described, it will be apparent that various modifications can be made without departing from the spirit and scope of the invention. For example, a particular width to height is shown in the drawings, but the safe 10 could be made wider with respect to its height to accommodate the storage of more items, such as additional handguns, magazines, ammo, or other valuables. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A safe for a firearm, comprising:

a container having a top, a bottom, a rear, a front, a first side, and a second side all defining an internal volume within the container, the front including a front opening;

a drawer having an open top, a first side, a second side, a front, a bottom and a rear, the drawer adapted for slidable receipt into the open front of the container, the open top of the drawer adapted for holding a portion of the firearm in a presentation position ready for grasping when the drawer is in an extended position away from the front of the container;

a drop-down panel slidably fixed with and surrounding the first side, front, and second side of the drawer when the drawer is in the extended position, and raised above the first side, front, and second side of the drawer when the drawer is in a retracted position inside the container, the drop-down panel and front of the drawer substantially covering the front opening of the container when the drawer is in the retracted position;

a ramp bracket fixed within the internal volume of the container and adapted for raising the drop-down panel with respect to the drawer when the drawer is pushed backward into the container;

a latch adapted for retaining the drawer in the retracted position against a spring urging the drawer into the extended position, the latch selectively openable with a lock mechanism that releases the latch when unlocked;

whereby with the firearm placed in the presentation position in the top of the drawer and with the drawer pushed into the retracted position, access to the firearm is prevented until the lock mechanism is unlocked, thereby releasing the latch so that the spring urges the drawer into the extended position, lowering the drop-down panel to present the firearm ready for grasping.

2. The safe of claim 1 wherein the ramp bracket further includes two rear rollers proximate a lower rear side of the drop-down panel and at least one front roller proximate a lower front side of the drop-down panel, the rear rollers adapted to ride on ramps fixed with the first and second sides of the container and adjacent to the drop-down panel, the at least one front roller adapted to slide within at least one vertical slot traversing proximate the front of the drawer.

3. The safe of claim 1 wherein the drawer is slidably supported within the container between the retracted and extended positions on a drawer slide mechanism.

4. The safe of claim 1 wherein the drop-down panel further includes an upper locking flange adapted for receipt within an upper locking slot of the front of the container proximate the top of the container, such that the upper locking flange of the drop-down panel is received within the upper locking slot of the container when the drawer is in the retracted position, whereby prying open of the container at the drop-down panel is inhibited when the drawer is in the retracted position.

5. The safe of claim 1 wherein the latch is disposed proximate the top of the container and within the internal volume of the container, the rear of the drawer extending upward to engage the latch and being substantially flush with a top edge of the drop-down panel when the drawer is in the retracted position.

6. The safe of claim 1 wherein the lock mechanism includes an electronic combination lock that includes a keypad disposed at the top of the container proximate the front of the container, whereby when a correct combination is entered into the keypad the electronic combination lock actuates a motor to release the latch.

7. The safe of claim 1 wherein the lock mechanism includes a mechanical key lock that includes a key slot at the front of the container proximate the top of the container, whereby when a key is turned in the mechanical key lock an armature between the mechanical key lock and the latch releases the latch.

8. The safe of claim 6 wherein the lock mechanism includes a mechanical key lock that includes a key slot at the front of the container proximate the top of the container, whereby when a key is turned in the mechanical key lock an armature between the mechanical key lock and the latch releases the latch.

9. The safe of claim 1 further including an L-shaped mounting bracket having a plurality of prongs and wherein the rear, left, right, and bottom of the container further include mounting slots formed therethrough and cooperative with the prongs of the mounting bracket, such that the mounting bracket when affixed with a structure is adapted to support the container on the structure when the mounting prongs are engaged with any of the mounting slots.

10. The safe of claim 9 wherein the mounting bracket further includes at least two standoffs for contacting the container when the container is mounted to the mounting bracket.

11. The safe of claim 6 wherein the electronic combination lock further includes a motor fixed with a flywheel adapted to rotate through a lock pin arm a lock pin that releases the latch.

12. The safe of claim 11 wherein the electronic combination lock further includes a battery and a circuit board having a circuit adapted to control the motor based on inputs made to the keypad.

* * * * *